United States Patent [19]

Ernstsson et al.

[11] 4,233,271

[45] Nov. 11, 1980

[54] ARRANGEMENT FOR THE STERILIZING OF A PACKING MATERIAL WEB

[75] Inventors: Ernst G. Ernstsson, Staffanstorp; Alfred Fuchs, Lund, both of Sweden

[73] Assignee: Tetra Pak International AB, Lund, Sweden

[21] Appl. No.: 26,058

[22] Filed: Apr. 2, 1979

[30] Foreign Application Priority Data

Apr. 5, 1978 [SE] Sweden ..... 7803828

[51] Int. Cl.[3] ..... A61L 2/18; B65B 55/10; B65B 55/24

[52] U.S. Cl. ..... 422/300; 53/167; 53/425; 134/15

[58] Field of Search ..... 422/28, 32, 31, 300, 422/302; 134/15; 53/167, 425

[56] References Cited

U.S. PATENT DOCUMENTS

| | | | |
|---|---|---|---|
| 3,383,831 | 5/1968 | Goldsmith et al. | 422/28 |
| 3,466,841 | 9/1969 | Rausing | 422/28 |
| 3,511,592 | 5/1970 | Tuma | 422/300 |
| 3,929,409 | 12/1979 | Buchner et al. | 134/15 |
| 3,947,249 | 3/1976 | Egger | 422/300 |
| 4,055,035 | 10/1977 | Sjostrand et al. | 422/28 |

FOREIGN PATENT DOCUMENTS

| | | |
|---|---|---|
| 2366997 | 5/1978 | France . |
| 1099294 | 1/1968 | United Kingdom . |
| 1394212 | 5/1975 | United Kingdom . |

*Primary Examiner*—Bradley R. Garris

*Attorney, Agent, or Firm*—Burns, Doane, Swecker & Mathis

[57] ABSTRACT

A arrangement for the sterilization of a web of packing material is provided which includes a container having an outer wall including an opening. A bath of sterilizing liquid is disposed within the container, with said liquid being conveyed onto the web by a rotary brush as the web is conveyed across the opening. Means to collect sterilizing liquid within the container after having contacted the web may also be provided.

7 Claims, 1 Drawing Figure

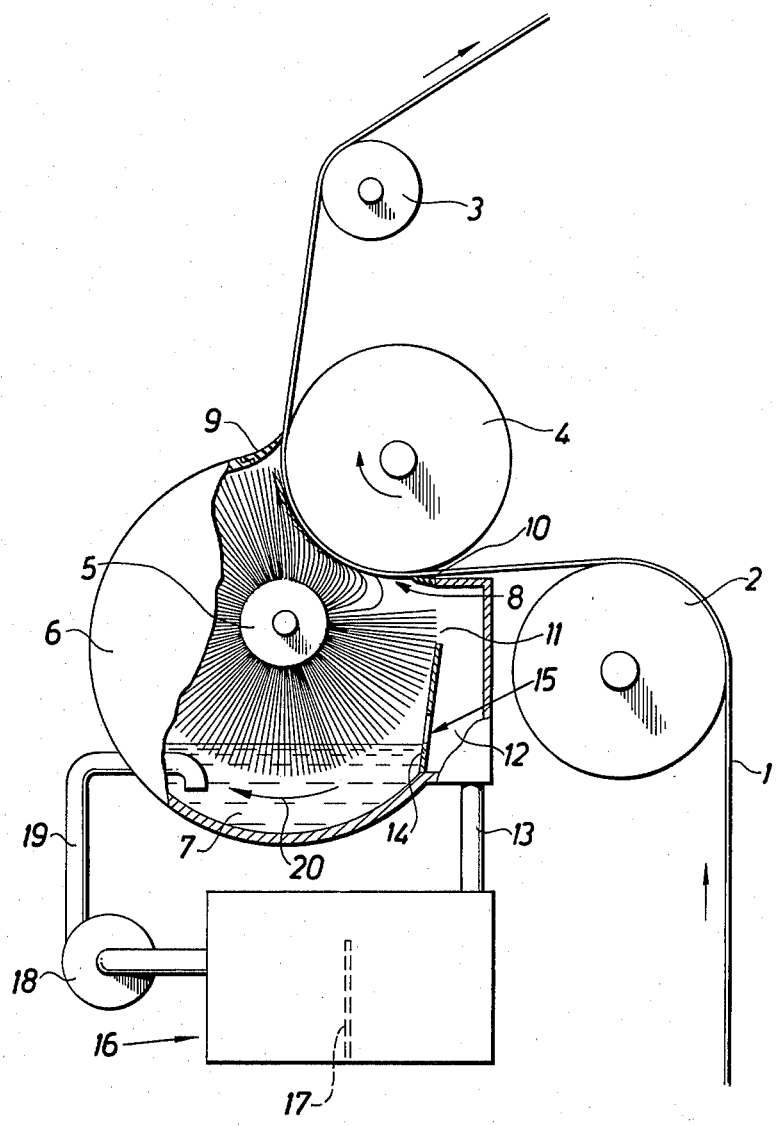
3
4
9
10
5
2
8
6
11
15
12
1
19
7
14
13
20
18
16
17

ARRANGEMENT FOR THE STERILIZING OF A PACKING MATERIAL WEB

The present invention relates to an arrangement for the sterilizing of a packing material web which in a packing machine is converted to individual packing units filled with sterile contents, which arrangement comprises units for the application of a liquid sterilizing agent to at least one side of the web as well as units for removing the sterilizing agent from the packing material web once the sterilizing effect has been achieved, the firstnamed units comprising a container for a sterilizing agent and a device arranged in the container for the mechanical cleaning of the web.

In Swedish patent application No. 76.11124-4 an arrangement is described for the cleaning and sterilizing of a material web passing through a packing machine. The arrangement described comprises among other things a container partly filled with sterilizing liquid through which the material web is adapted to pass while being treated at the same time by means of a rotary brush, sponge or the like, which is in contact with the side of the material web which subsequently will constitute the inside of the packing container.

In practical tests of this arrangement it has been found, however, that it has not been possible to meet the high demands made with respect to effective cleaning and bactericidal capacity. This is due among other things to the fact that the available time for treatment is very short. It has been necessary, therefore, to redesign the arrangement with the object of increasing its effectiveness. The aim was in particular that the web should be treated vigorously by the fibers of the brushing device at the same time as it is subjected to a powerful stream of sterilizing agent.

It was a further demand that the consumption of the sterilizing agent should be reduced, e.g. through re-use of the sterilizing agent, which necessitates however an intermediate purification process, since the agent may only contain a very limited portion of the contaminates from previous utilization.

Thus it is the object of the present invention to provide a design which meets the above demands and which moreover is optimized to give the best possible cleaning and bactericidal effect in the limited time for treatment and the limited space available in a modern packing machine.

These and other objects have been achieved in accordance with the invention in that an arrangement for the sterilizing of a packing material web, which in a packing machine is converted to individual packing units filled with sterile contents, which arrangement comprises units for the application of a liquid sterilizing agent to at least one side of the web, as well as units for removing the sterilizing agent from the packing material web once the sterilizing effect has been achieved, the first named units comprising a container for the sterilizing agent and a device arranged in the container for the mechanical washing of the web, has been given the characteristic that the device comprises of a rotatable brushing device which is so positioned in the container that on rotation it mechanically treats the said side of the web at the same time as the same is moistened with the sterilizing agent.

A preferred embodiment of the arrangement in accordance with the invention has been given the further characteristic that the brushing device is arranged substantially cylindrically and horizontally in the container so that its lower part is in contact with the sterilizing agent present in the container, and its upper part is in contact with the packing material web. In this manner the brushing device, open rotation, will transfer sterilizing agent to the packing material web.

A further embodiment of the arrangement in accordance with the invention has been given the further characteristic that the brush fibers of the brushing device before contact is made with the material web will pass through a space which is tapered as in the direction of rotation and which concentrates the flow of sterilizing agent towards the material web. As a result the rate of flow of the sterilizing agent becomes higher and the agent will be flung with greater force towards the material web.

A further embodiment of the arrangement in accordance with the invention has been given the further characteristic that the container is substantially cylindrical with a diameter which somewhat exceeds the diameter of the brushing device, the central axle of the brushing device being located a little above the central axle of the container, so that a free volume, not swept by the brush, is formed in the base of the container. Owing to this container form on the one hand a free space for the sterilizing agent is provided in the container base while on the other hand the tapered space is created which is desirable in order to increase the rate of flow of sterilizing agent toward the material web.

A further embodiment of the arrangement in accordance with the invention has been given the further characteristic that the container in its upper part has a slot-shaped opening extending parallel with the longitudinal axis of the brush which is taken up by a cylinder which with a portion of its peripheral surface projects into the container so that a material web passing over the cylinder will with its one side come into contact with the brush.

A further embodiment of the arrangement in accordance with the invention has been given the further characteristic that the brush and the material web at the point of contact have opposite directions of movement.

A further embodiment of the arrangement in accordance with the invention has been given the further characteristic that the slot-shaped opening is provided with elements forming a seal against the cylinder.

A further embodiment of the arrangement in accordance with the invention finally has been given the further characteristic that the container has a slot-shaped opening arranged after the said opening as seen in the direction of rotation of the brush, which slot-shaped opening leads to a collecting device for the sterilizing agent flung off the brush.

A preferred embodiment of the arrangement in accordance with the invention will be described in detail with special reference to the enclosed schematic drawing which shows the arrangement from the side and partly in section.

The arrangement in accordance with the invention is intended to be mounted in a packing machine of e.g. the type which is described in the application, to which reference has been made. The arrangement is placed so that a material web 1 passes with the aid of guide rollers 2,3 through the arrangement and more particularly between the counter-cylinder 4 and the brushing device 5. The counter-cylinder 4 is a cylindrical, plain steel roll which is suspended so that it can freely rotate at a little distance from the brushing device 5 and parallel with the same. The brushing device 5 consists of a rotary axle which is adapted so as to be driven by means of an electric motor (not shown on the drawing). The peripheral surface of the axle is provided with a large number of brush fibers which are manufactured from a material resistant to the sterilizing agent used, e.g. polypropylene. The brushing device 5 is situated in a container 6 which is made of a rustfree material and is of substantially cylindrical shape. The brushing device 5 is supported eccentrically in relation to the container 6 and, more particularly, is displaced upwards to such an extent that the brush fibers of the brushing device 5 come closest to the inside of the container in the upper part of the container. This also means that a free space 7 is created in the lower part of the container.

As mentioned previously, the container 6 is of substantially cylindrical shape with a somewhat larger diameter than the brushing device 5. In the upper part of the container, however, there is a slot-shaped opening 8 which is relatively wide and extends alongside the container 6, that is to say, parallel with the central axle of the container as well as of the brushing device. Through the opening or slot 8 the counter-cylinder 4 partly projects into the container so that its surface facing the brushing device 5 will be in contact with the fibers of the brushing device. The edges of the slot are provided with sealing devices, 9,10 which rest flexibly against the surface of the counter-cylinder 4.

Directly adjoining the slot 8 the container 6 has a further slot-shaped opening 11 which extends parallel with the slot 8 and similarly to it has a length which substantially coincides with the length of the brushing device 5. The slot 11 connects the inside of the container with a collecting space 12 for the sterilizing liquid which space 12 is drained by means of a pipe 13 for the sterilizing liquid used. A wall, 14, situated between the collecting space 12 and the container 6, is positioned so that its upper edge delimiting the slot 11 directly adjoins the outer boundary surface of the brushing device which is defined by the ends of the brush fibres. The wall 14 is also provided with holes 15 serving as an open-width outlet for the container 6.

The drainage pipe 13 for used sterilizing liquid leading from the collecting space 12 ends in a tank 16 situated underneath the arrangement which by means of a number of partitions (only one of which being indicated in the drawing, is divided into a number of sedimentation basins for the sterilizing medium. A circulation pump 18 which is connected on its suction side to the tank 16 connects the tank 16 via a pipe 19 to the free space 7 in the lower part of the container 6. Further purification devices in the form of filters or the like may also be provided.

In addition to what has been mentioned above, the arrangement in accordance with the invention comprises a great number of mechanical elements such as fixing devices, bearings and the like together with guiding and driving elements e.g. for the circulation pump and the electric motor rotating the brushing device. These elements, however, are all of a type well known to those skilled in the art and will therefore not be described in detail.

When the arrangement in accordance with the invention is in operation the packing material web 1 is driven at substantially uniform speed by the driving device of the packing machine. The material web passes via the guide rollers 2,3, the counter-cylinder 4 which, as described previously, partly projects into the container 6 of the arrangement. The material web passes between the peripheral surface of the counter cylinder 3 and the sealing device 10 situated on one side of the slot 8 which presses the material web against the surface of the counter-cylinder 4 and provides a seal preventing any sterilizing liquid from being ejected. After the packing material web 1 has passed substantially one quarter of the circumference of the counter-cylinder 4 it emerges again from the container 6, the sealing device 9 pressing the material web against the surface of the counter-cylinder 4 so that here too no sterilizing agent can issue from the container 6. The sealing device 9 will also scrape off any excess quantity of the sterilizing liquid from the material web 1 before the material web leaves the container 6. In the event that the control of this scraping effect is desirable the flexibility of the sealing device 9 may be varied, e.g. by means of adjustable screws or the like.

Before the arrangement in accordance with the invention is used it should be ensured that the system holds a sufficient quantity of some suitable sterilizing agent, e.g. hydrogen peroxide. A suitable level of sterilizing agent in the container 6 has been indicated by means of a dash-dotted line. The circulation pump 18 is started and the sterilizing liquid flows from the tank 16 via the pump 18 and the pipe 19 to the free space 7 in the base of the container 6. If the level happens to rise above the said dash-dotted line, the excess of sterilizing liquid will flow via the open width outlet 15 to the collecting space or the collecting device 12 and from there via the pipe 13 back to the first sedimentation basin in the tank 16. The electric motor (not shown) which, possibly via a gear, drives the brushing device 5 is now started, so that the brushing devices commences to rotate in the direction of rotation indicated by the arrow 20 at a speed of between 200 and 500 revolutions per minute. Since a part of the brush fibers of the brushing device 5 extend down into the sterilizing liquid which is present in the base of the container 6, a part of the latter will accompany the fibers in the direction of rotation of the brushing device 5. Thus the sterilizing agent will be "climbing" up the peripheral wall of the container 6, and since the distance between the wall and the ends of the brush fibers progressively diminishes, the speed of movement of the sterilizing liquid will be successively increased until in the upper part of the container 6 it substantially coincides with the peripheral speed of the brushing device. The sterilizing liquid will now strike the material web passing over the counter-cylinder 4 at the same time as the brush fibers of the brushing device 5, so that a very good cleaning and sterilizing effect is achieved. This effect is further enhanced owing to the distance between the peripheral surface of the counter-cylinder and the brushing device 5 being less than the length of the brush fibers, so that during rotation of the brushing device 5 the brush fibers are strongly bent as they are forced past the material web 1 moving over the counter-cylinder 4, which is thus subjected to a strong mechanical treatment.

When the brush fibers have passed the narrow space between the counter-cylinder and the brush device 5 they will owing to their flexibility vigorously spring back to their original radial position, so that the accompanying sterilizing liquid, which now has some contaminations and bacteria from the material web mixed in with it, will be flung off the fibers and via the slot 11 into the collecting space 12. This method of separation, which in practice has proved very effective, means that the bulk of the contaminated sterilizing agent is removed from the brush fibers and is collected so as to be discharged further to the sedimentation space in the tank 16 where contaminations and bacteria successively deposit at the bottom, so that substantially pure sterilizing liquid can be withdrawn from the tank to be returned again via the pump to the container 6.

The arrangement in accordance with the invention, notwithstanding its particularly simple and cheap design, has proved in practical tests to give a surprisingly accurate cleaning and sterilizing of the packing material web. This appears to be due to the combination of the high speed at which the sterilizing liquid is flung against the packing material web, the vigorous mechanical treatment of the web and the effective separating arrangement for contaminated sterilizing liquid, which in spite of circulation of the sterilizing agent with accompanying slight consumption ensures that substantially uncontaminated sterilizing agent is utilized the whole time for the sterilizing of the web. The arrangement in accordance with the invention thus combines effective cleaning and sterilizing with very small consumption of sterilizing liquid, while the arrangement is compact and therefore well-suited for being incorporated in packing machines of the known type.

We claim:

1. An arrangement for the sterilizing of a web of packing material which is subsequently formed into packing containers comprising:

a container for a sterilizing liquid, said container having an outer wall, said outer wall having an opening therein;

a rotary brush disposed within said container, means mounting said brush for rotation about an axis, a first portion of said outer wall that is adjacent said opening being closer to said axis than a second portion of said outer wall that is on the opposite side of said opening from said axis, and said outer wall being spaced progressively closer to said axis from said second portion toward said first portion;

said container including a reservoir to receive sterilizing liquid along said second portion; and means to convey a web of packing material across said opening whereby said rotary brush dips into said reservoir and cooperates with said outer wall to concentrate the flow of sterilizing liquid toward and into contact with said packing material web.

2. The arrangement of claim 1 wherein the container is substantially cylindrical and the axis of said rotary brush is substantially parallel to the longitudinal axis of the container.

3. The arrangement of claim 1 wherein said means to convey the web of packing material includes a cylindrical roller, a portion of the peripheral surface of which is disposed within said opening and around which the web of packing material travels.

4. The arrangement of claim 1 wherein the container further includes means to collect sterilizing liquid subsequent to contacting said web of packing material, said means being disposed adjacent said rotary brush within said container such that after the brush comes into contact with the web, sterilizing liquid disposed on said brush is flung toward said collection means and collected therein.

5. The arrangement of claim 4 wherein said means to collect sterilizing liquid includes an opening adjacent said rotary brush through which the sterilizing liquid passes after leaving said brush.

6. The arrangement of claim 1 wherein said means to convey the web of packing material conveys said web in a direction opposite to that in which the brush rotates.

7. The arrangement of claim 1 further including means to form a seal between the opening and the web as it is conveyed over said opening.

* * * * *